US006092443A

United States Patent [19]

Zayat, Jr.

[11] Patent Number: 6,092,443

[45] Date of Patent: Jul. 25, 2000

[54] UNIVERSAL SOCKET TOOL

[76] Inventor: Charles D. Zayat, Jr., 100 New Hampshire St., Cranston, R.I. 02920

[21] Appl. No.: 08/933,912

[22] Filed: Sep. 23, 1997

[51] Int. Cl.[7] ..... B25B 13/06

[52] U.S. Cl. ..... 81/185; 81/DIG. 11; 81/124.5

[58] Field of Search ..... 81/185, DIG. 11, 81/124.4, 124.5, 461, 442, 448

[56] References Cited

U.S. PATENT DOCUMENTS

| | | |
|---|---|---|
| 1,997,948 | 4/1935 | Pearson . |
| 3,251,251 | 5/1966 | Popper et al. . |
| 3,349,655 | 10/1967 | Locke . |
| 3,698,267 | 10/1972 | Denney . |
| 3,858,468 | 1/1975 | Pasbrig . |
| 4,416,173 | 11/1983 | Rebish . |
| 4,887,498 | 12/1989 | Zayat . |
| 4,936,560 | 6/1990 | Barozzi . |
| 5,287,778 | 2/1994 | Cook . |
| 5,460,064 | 10/1995 | Zayat, Jr. . |
| 5,829,328 | 11/1998 | Chen ..... 81/185 |

FOREIGN PATENT DOCUMENTS

| | | |
|---|---|---|
| 315926 | 11/1919 | Germany . |
| 2240058 | 4/1990 | United Kingdom . |

*Primary Examiner*—D. S. Meislin
*Attorney, Agent, or Firm*—Barlow, Josephs & Holmes, Ltd.

[57] ABSTRACT

A universal socket tool for rotating a fastener element includes a rigid housing comprising a conventional socket casing having a polygonal shaped longitudinal chamber, the chamber having an end wall at its upper end and an open lower end. An array of primary engagement pins, each having upper and lower ends, are longitudinally oriented in the chamber. A pair of spaced apart, secondary engagement pins, each having upper and lower ends, are also longitudinally oriented in the chamber with the primary engagement pins disposed therebetween. The secondary engagement pins are preferably triangular in cross-section so as to fill the polygonal cavity of the housing. Springs are provided for attaching the primary and secondary engagement pins to the upper end of the chamber of the housing. In a second embodiment, a sleeve-type suspension mechanism is provided for positively securing the pins to the housing so that the pins cannot be pulled out of the housing. In a third embodiment, a sleeve-type suspension system incorporating a rack plate is further provided.

11 Claims, 6 Drawing Sheets

UNIVERSAL SOCKET TOOL

BACKGROUND OF THE INVENTION

This invention relates generally to socket tools, and more particularly to a universal socket tool which is operative for turning a plurality of different size fastener elements, such as nuts, bolts, etc.

Universal socket tools have heretofore been known in the art. In this connection, reference can be made to applicant's earlier issued U.S. Pat. Nos. 4,887,498 and 5,460,064 which represent the closest prior art of which applicant is aware.

The '498 patent is directed to a universal socket tool comprising a housing forming a chamber having an open lower end, and a bundle of over four hundred individual pins suspended longitudinally within the chamber by a plurality of side-by-side rails. The lower ends of the pins engage various fastener elements, such as nuts, bolts, etc., when the lower ends of the pins are pressed downwardly over the fastener element. The pins are suspended such that when the lower ends of the pins engage the fastener element, the engaged pins are forced to slide upwardly into the chamber. A highly complex spring assembly is provided for returning the pins to their original position after pressured engagement with the fastener element is removed.

The socket tool disclosed in the '064 patent, in one embodiment, comprises a rectangular housing having a longitudinal chamber with an open lower end. The rectangular configuration of the housing prevents the rolling of the socket tool when it is placed on a flat surface. An eight-by-eight array of square pins is longitudinally oriented in the chamber, the lower ends of the pins being flush with the open end of the chamber for engaging a variety of fastener elements having different shapes and sizes. The pins are suspended in the chamber in individual sliding relation wherein engagement of the lower ends of the pins with a fastener element forces the engaged pins upwardly into the chamber.

In one embodiment disclosed in the '064 patent, the suspension system includes upper and lower suspension plates which are mounted in closely spaced parallel relation in the chamber. The upper and lower suspension plates have aligned apertures for slidably receiving the pins. A flange at the top of each pin is positioned above the upper plate and the lower end of each pin is located below the lower plate. Each of the pins is further provided with a coil spring disposed around its upper end for returning the pins to their normal position after engagement with the fastener element. The upper and lower suspension plates are preferably divided into four separate plate segments so that the pins can be assembled into sub-groups.

In another embodiment, the springs are attached to the upper end of the chamber by a layer of adhesive (e.g., synthetic resin) wherein the second ends of the springs are imbedded in the layer of adhesive for suspending the pins.

While the socket tools disclosed in the '498 and '064 patents are highly effective in operation for their intended purpose, the large number of pins and the manner in which they are attached to the housing still needs improvement. The present invention is directed to reducing the number of pins, simplifying the housing structure, and improving the connection of the pins to the housing.

SUMMARY OF THE INVENTION

The socket tool of the present invention comprises a rigid housing having a longitudinal chamber, the chamber having an end wall at its upper end and an open lower end. In the preferred embodiment of the invention, the housing comprises a standard six-sided, i.e. polygonal, socket casing having a plurality of angled sides. A rectangular array of primary engagement pins, each having upper and lower ends, are longitudinally oriented in the central portion of the chamber. The lower ends of the pins are positioned adjacent the lower end of the chamber for engagement with the fastener element. A pair of spaced apart, secondary engagement pins, each having upper and lower ends, are also longitudinally oriented in the chamber, with the array of primary engagement pins disposed therebetween. In order to completely fill the polygonal cavity of the housing, the secondary engagement pins are preferably triangular in shape. Previously, a custom manufactured housing having a quadrilateral chamber was utilized with an array of all square engagement pins. It has been found that the present arrangement reduces the number of pins, and eliminates the need for a custom housing without sacrificing performance of the device. An adhesive suspension means is provided for attaching the primary and secondary engagement pins to the upper end of the chamber of the housing via coil springs.

One drawback to the prior art devices is that the spring mounted pins can be pulled out of the housing. In this situation, the tool is ruined because the spring on the pulled pin is stretched out of normal relaxed state and will not recoil back into the housing. Accordingly, in a second aspect of the invention, a universal socket tool employs a unique suspension system that prevents the pins from being pulled out of the housing. The housing and pin arrangement are as described previously. However, the suspension arrangement comprises plurality of elongate guide elements secured to the upper end of the chamber of the housing, and a plurality of elongate sleeves secured to the upper ends of the pins. The lower end of the guide elements include a head portion while the upper end of the sleeve includes an annular end wall. The arrangement is such that the elements are axially movable within respective sleeves with the head portion of the elements engaging the annular end wall of the sleeve to prevent the engagement pins from being pulled out of the housing. Springs are mounted inside and outside the sleeve to bias the engagement pins downwardly.

Accordingly, among the several objects of the present invention are: the provision of a universal socket tool which is operative for engaging and turning a plurality of different size fastener elements; the provision of such an improved universal socket tool which requires less engagement pins than prior art universal socket tools; the provision of a universal socket tool which utilizes a conventional off the shelf socket casing as a housing; the provision of a pin arrangement which effectively fills a polygonal chamber of a conventional socket casing; and the provision of a universal socket tool having an improved suspension system which is reliable in construction, relatively simple to manufacture and prevents the pins from being pulled out of the housing.

Other objects, features and advantages of the invention shall become apparent as the description thereof proceeds when considered in connection with the accompanying illustrative drawings.

BRIEF DESCRIPTION OF THE DRAWINGS

In the drawings which illustrate the best mode presently contemplated for carrying out the present invention.

Corresponding reference numerals designate corresponding parts throughout the several views of the drawings.

DETAILED DESCRIPTION OF THE PREFERRED EMBODIMENTS

Figure 1:
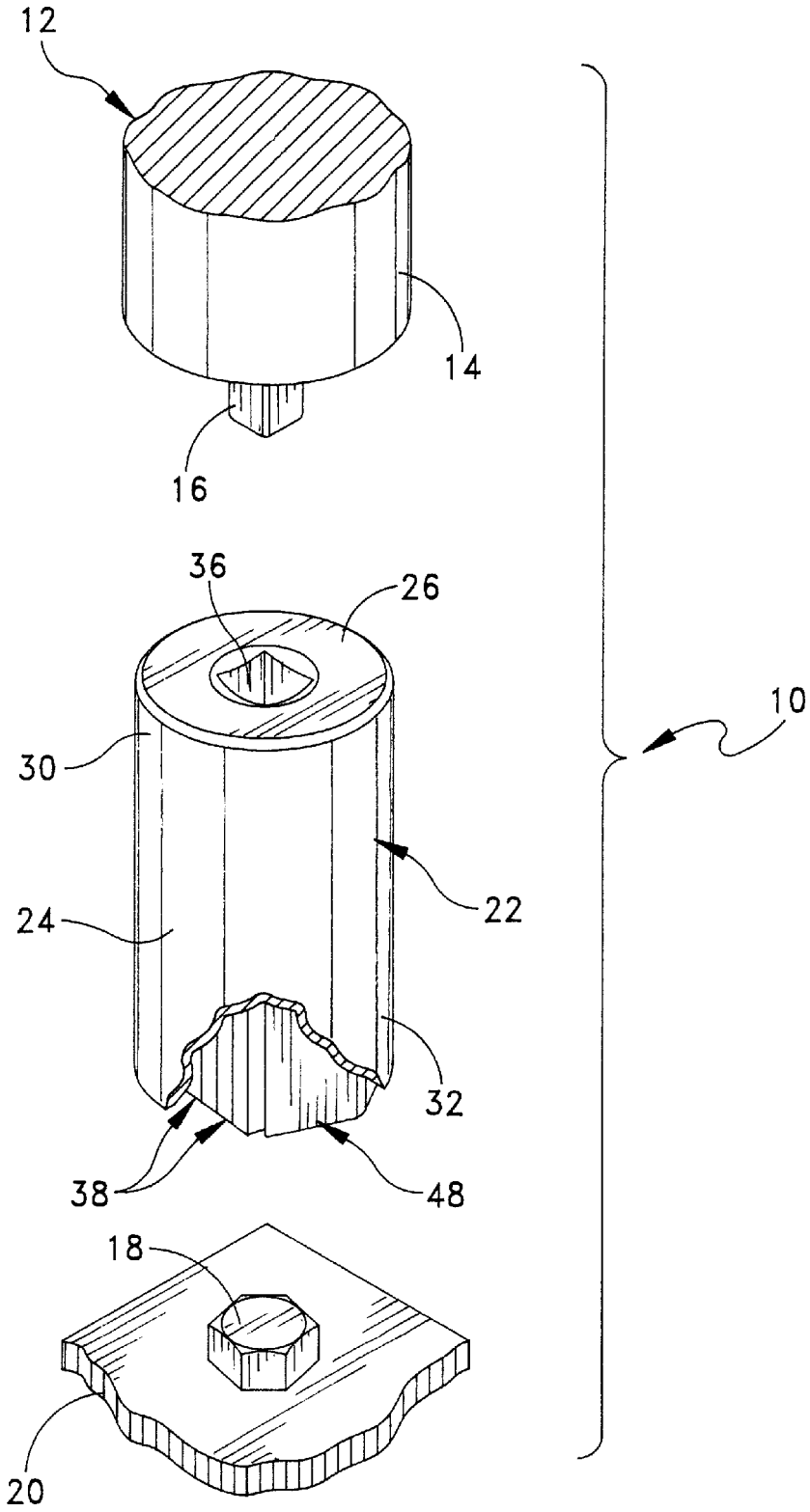
FIG. 1 is an exploded perspective view of a universal socket tool of the present invention having portions removed to illustrate interiorly positioned components of the socket tool.
Figure 2:
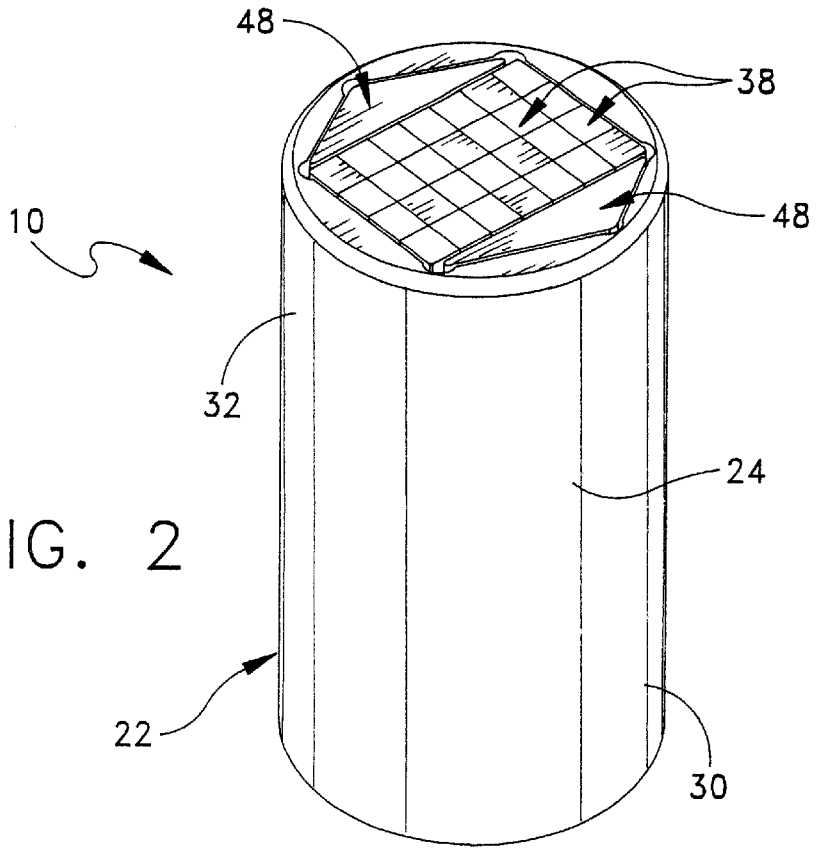
FIG. 2 is a perspective view of the socket tool in assembled relation.

Referring to the drawings, and to FIGS. 1 and 2 in particular, there is generally indicated at 10 a universal socket tool of the present invention which is especially suited for turning a plurality of different size fastener elements, such as nuts, bolts, screws, eye bolts, and wing nuts. As will hereinafter be more fully described, the instant universal socket tool 10 is operative in connection with a drive tool generally indicated at 12 (partially illustrated in FIG. 1) for turning a plurality of different fastener elements. The drive tool 12 comprises a conventional socket driver 14 having a square mounting lug 16. A fastener element 18 illustrated in FIG. 1 comprises a hex head bolt which is threadedly mounted in a flat plate 20. As mentioned above, the instant universal socket tool 10 is suited for turning other types of fasteners as well.

Figure 4:
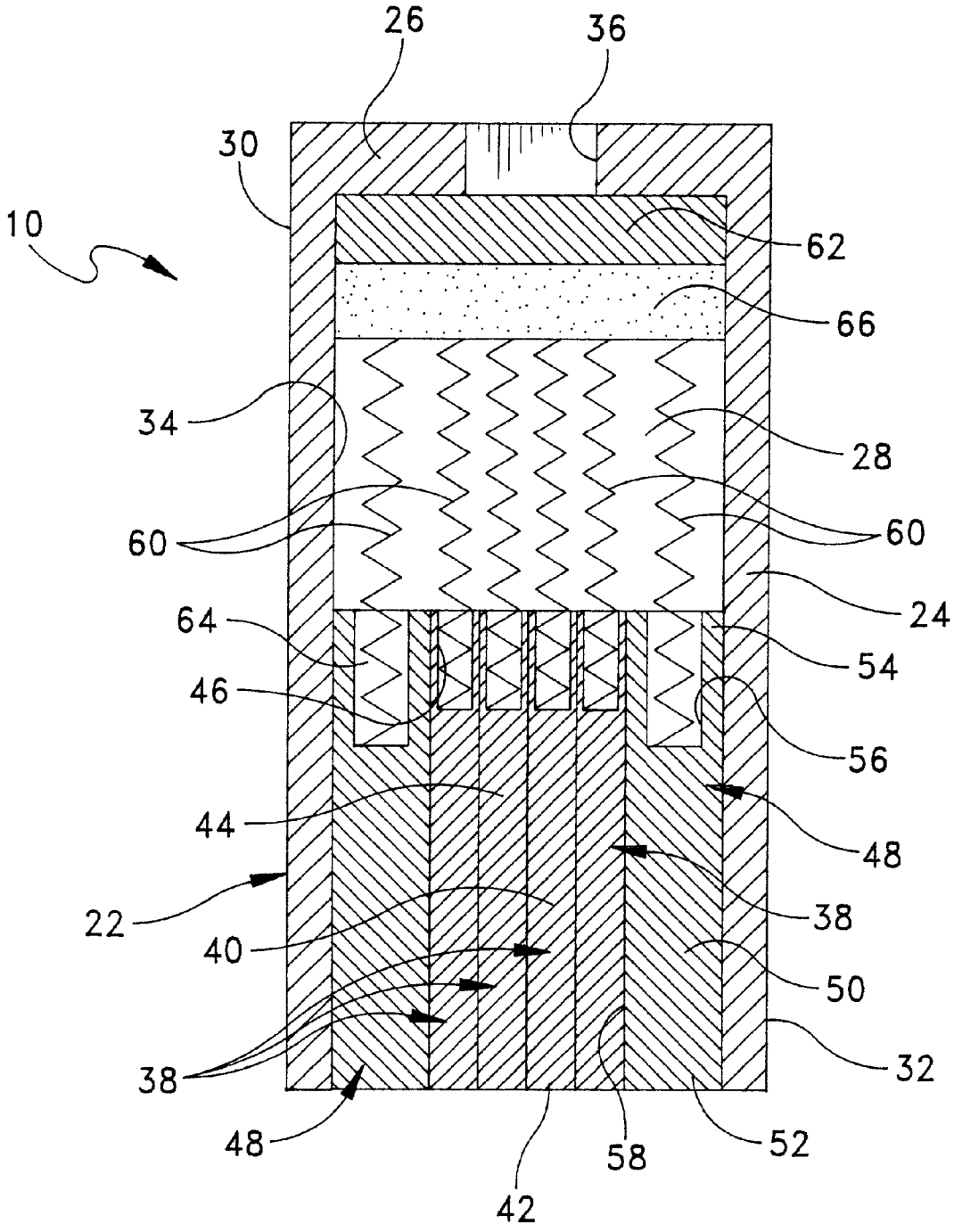
FIG. 4 is a cross-sectional view of the socket tool taken along line 4–4 of FIG. 3.

The universal socket tool 10 comprises a rigid housing, generally indicated at 22, having a cylindrical wall 24 and an annular wall 26 which together define a longitudinal polygonal-shaped chamber 28 (FIG. 4). The housing 22 further includes an upper end 30 and an open lower end 32. The housing 22 is preferably tubular in configuration, and in this connection, it preferably comprises a standard ⅞ inch stainless steel socket casing which defines the longitudinal chamber 28. However, it should be understood that the principles of the present invention can be applied to a housing 22 socket of virtually any size and still fall within the scope of the invention (e.g., socket sizes of ⅝ inch, ⅞ inch and 1 ⅛ inches). The inner surface 34 of the cylindrical wall 24 is hexagonal in shape, i.e. having six sides.

Provided in the annular wall 26 is a drive receptacle 36 for receiving the lug 16 of the socket driver 14. The drive receptacle 36 is defined by a square opening centrally located in the end wall 26. As illustrated in FIG. 4, the annular wall 26 is preferably integrally formed with the cylindrical wall 24; however, it should be noted that they can comprise two separate pieces that are joined together. The drive receptacle 36 is operative for snap-fitting receipt of the lug 16 of the socket driver 14 so that the universal socket tool 10 can be used in a conventional manner.

Figure 3:
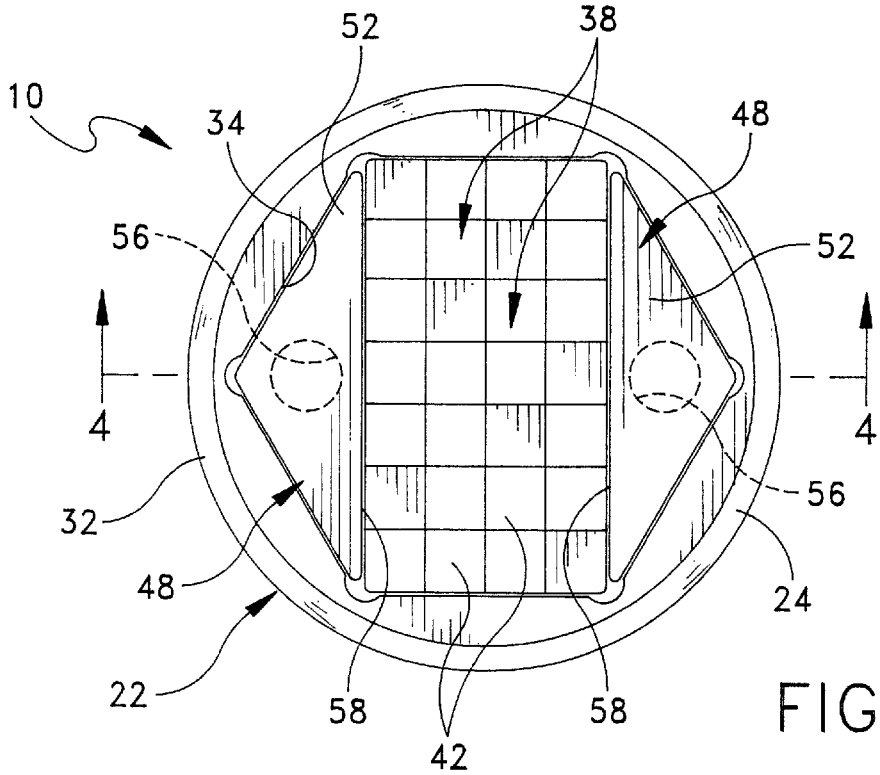
FIG. 3 is a top plan view of the socket tool.

Turning to FIGS. 2 and 3, the universal socket tool 10 further comprises a plurality of individual, primary engagement pins, each generally indicated at 38, which are slidably suspended within the chamber 28. Each individual primary engagement pin 38 comprises a square-shaped body 40 having a lower end 42 which is capable of engaging the fastener element 18, and an upper end 44 having an axial bore 46 formed therein. In the illustrated embodiment of the invention, the primary engagement pins 38 are arranged in a four-by-seven rectangular array and are longitudinally oriented and. slidably suspended in a first normal position (FIG. 4) within the chamber 28 of the housing 22 so that the lower ends 42 of the pins 38 are adjacent the open end 32 of the housing 22. The primary engagement pins 38 are preferably mounted so that they are flush with the end of the chamber 28 as illustrated, or alternately, the pins can extend below the lower end 32 of the housing 22 in order to engage below surface screws or bolts, such as those positioned in recessed cavities.

In addition to the primary engagement pins 38, the universal socket tool of the present invention comprises a pair of spaced apart, secondary engagement pins, each being generally indicated at 48. Each secondary engagement pin has a triangularly-shaped body 50 having a lower end 52 and an upper end 54 with an axial bore 56 formed therein. The secondary engagement pins 48 are also longitudinally oriented within the chamber 28 of the housing 22 with the primary engagement pins 38 disposed therebetween. As shown in FIG. 4 and mentioned above, both of the secondary engagement pins 48 are triangularly-shaped and disposed within opposite corners of the chamber 28 of the housing 22. The primary engagement pins 38 are disposed between the secondary engagement pins 48 so that the primary engagement pins 38 engage the major surfaces 58 of the secondary engagement pins 48 (FIG. 3).

As noted above in the Summary of the Invention, the prior art primarily utilized a custom manufactured housing having a quadrilateral chamber with an array of all square engagement pins. Although quite effective, the cost of manufacturing a custom housing significantly increased the manufacturing costs of the device. The Applicant has advantageously made use of a conventional, and inexpensive, off-the-shelf socket casing for the present device. However, in doing so, the Applicant was required to modify the shape and arrangement of the pins to accommodate the polygonal shape of the socket casing. It has been found that the present arrangement reduces the number of pins, and eliminates the need for a custom housing without sacrificing performance of the device. More specifically, it has been discovered that the provision of relatively large triangularly-shaped engagement pins 48 disposed oppositely from one another with relatively small square-shaped engagement pins 38 disposed therebetween can accommodate fastener elements 18 of varying shapes and sizes as well as the prior art devices. This arrangement reduces the amount of pins necessary for the universal tool 10 to operate. For example, the tool 10 disclosed in the '032 patent required sixty-four pins to operate, whereas the tool of the present invention requires only thirty pins. This reduces the overall cost of manufacturing the universal socket tool 10 of the instant invention without sacrificing performance.

Referring now to FIG. 4, the primary and secondary engagement pins 38, 48 are suspended within the chamber 28 in individual sliding relation in which the engagement of the pins with the fastener element 18 forces the engaged pins upwardly into the chamber 28 to a second position (not shown). More specifically, the primary and secondary engagement pins 38, 48 are suspended within the chamber 28 by means of compression springs, each indicated at 60, having lower (first) ends which are secured to the upper ends 44 of the primary pins 38, and upper (second) ends which are secured to an end wall 62 disposed within the chamber adjacent the annular wall 26 of the housing 22. The springs 60 are secured to the primary and secondary engagement pins 38, 48 by any suitable means, e.g., adhesive, staking, pinning, etc. As shown, the bores 46, 56 of the pins 38, 48, respectively, receive the lower ends of the springs 60 therein. Adhesive 64 is preferably disposed within the bores 46, 56 for attaching the springs 60 to the upper ends 44, 54 of the pins 38, 48. In addition, the upper ends of the springs 60 are attached to the end wall 62 disposed within the chamber 28 of the housing 22 preferably by a layer of adhesive 66, such as synthetic resin material of epoxy glue. These methods, along with other useful methods of securing the springs 60 to the pins 38, 48 and the housing 22, are disclosed in the '064 patent. Therefore, no further description is believed to be necessary.

In use, the primary and secondary engagement pins 38, 48 are pressed downwardly over the top of the fastener element 18. In this connection, the engagement of the primary and secondary pins 38, 48 against the fastener element 18 force them upwardly within the chamber 28 to the second position. The remaining unengaged pins are operative for engaging and grasping the sides of the fastener element 18 and rotating same when the socket tool 10 is rotated by the socket driver 14. The primary and secondary engagement pins 38, 48 return to their normal first position by the compression springs 60 when pressured engagement of the socket tool 10 over the fastener element 18 is eliminated.

Figure 5:
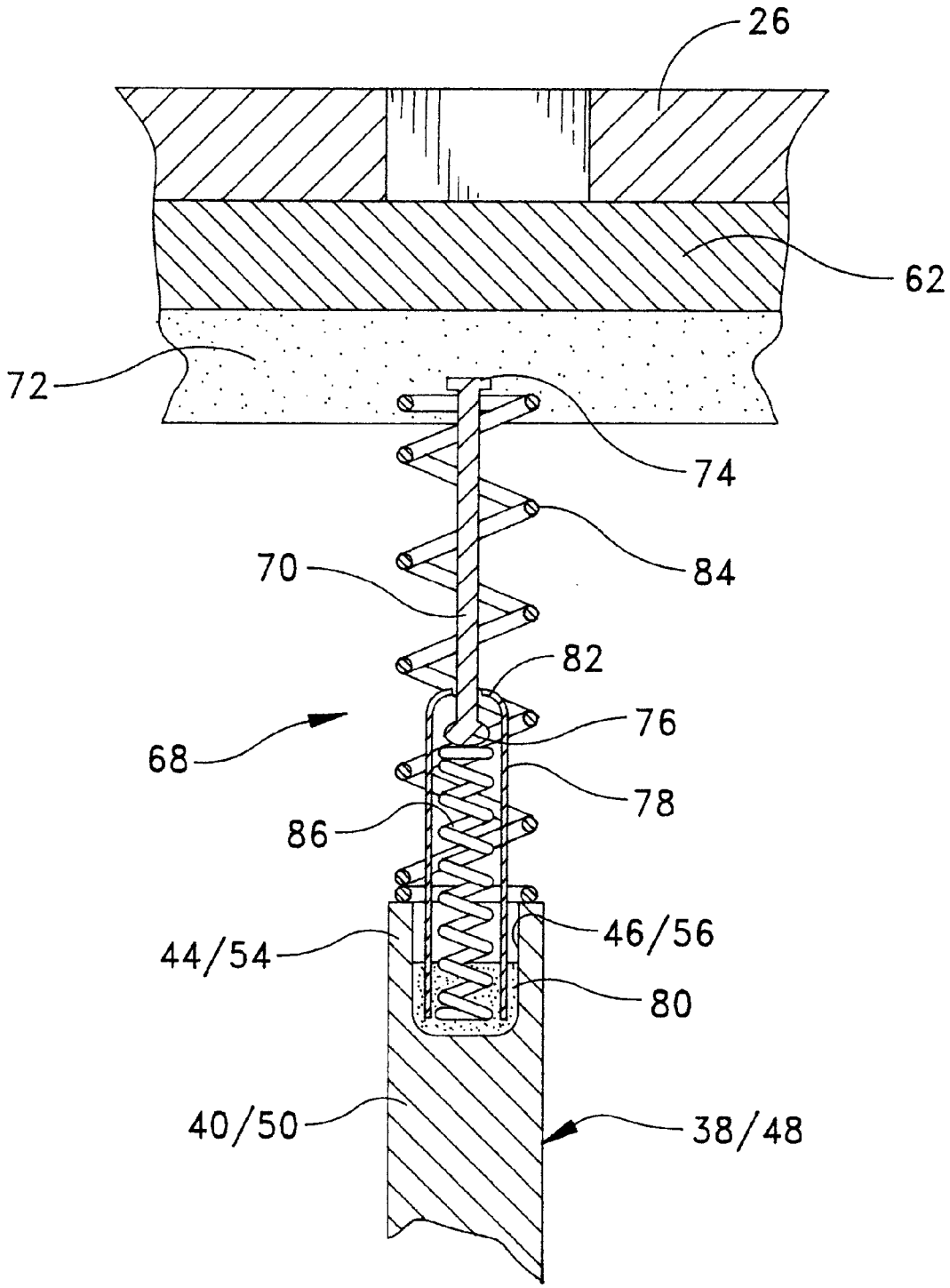
FIG. 5 is an enlarged cross-sectional view of a pin of the socket tool, and an alternate means of the present invention for attaching it to a housing of the socket tool.

Turning now to FIG. 5, there is illustrated a fastening mechanism, generally indicated at 68, of another preferred embodiment for securing the primary and secondary pins 38, 48 to the end wall 62 of the housing 22. One drawback to the prior art devices is that the spring mounted pins can be pulled out of the housing. In this situation, the tool is ruined because the spring on the pulled pin is stretched out of normal relaxed state and will not recoil back into the housing. The intention of the present fastening mechanism is to prevent the pins from being inadvertently or intentionally pulled out of the interior of the housing.

As shown, the fastening mechanism 68 includes an elongate guide element 70 which is secured to the end wall 62 of the housing by a layer of adhesive 72. The guide element 70 includes at its upper end a flange 74 for ensuring the positive securement of the element 70 within the layer of adhesive 72, and at its lower end a bulbous head portion 76.

The fastening mechanism 68 further includes an elongate sleeve 78 which is secured to the pin 38 or 48 within its bore 46 or 56 by adhesive 80. The sleeve 78 extends axially away from the pin 38 or 48 towards the elongate element 70 wherein the bulbous head portion 76 of the elongate element 70 is disposed within the sleeve 78. The upper end of the sleeve 78 is deformed so as to create an annular end wall 82 which engages the bulbous head portion 76 of the element 70 for preventing the axial removal of the element from the sleeve 78.

In one embodiment, a spring 84 is disposed around the outside of the element 70 and sleeve 78 arrangement for biasing the pin 38 or 48 away from the housing 22. The upper end of the spring 84 is embedded in the layer of adhesive 72 and the lower end thereof engages the upper end of the pin 38 or 48. Alternatively, a spring 86 can be disposed within the sleeve 78 for engaging the bulbous head portion 76 of the element 70, the spring 86 being illustrated by broken lines. Either of the springs 84 or 86 can be provided individually, or both springs 84, 86 can be provided at the same time for increasing the biasing force.

Figure 6:
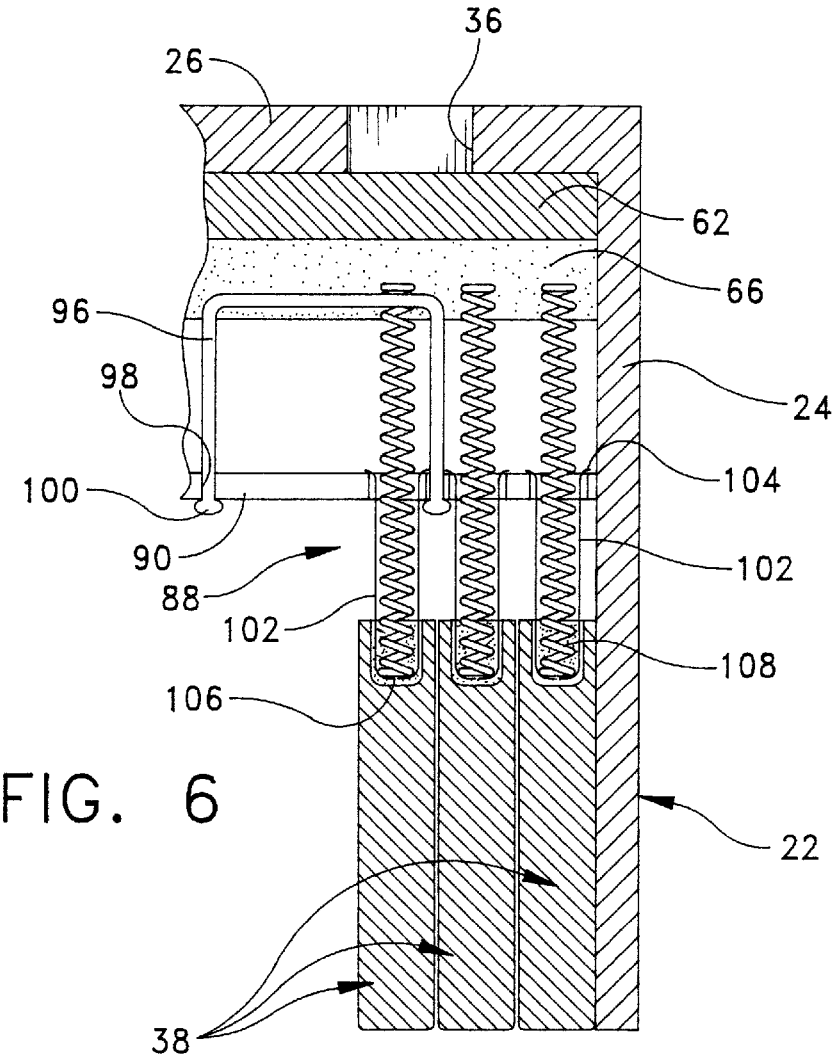
FIG. 6 is a partial cross-sectional view of several pins of the socket tool, and another alternate means of the present inventions for attaching them to the housing.
Figure 7:
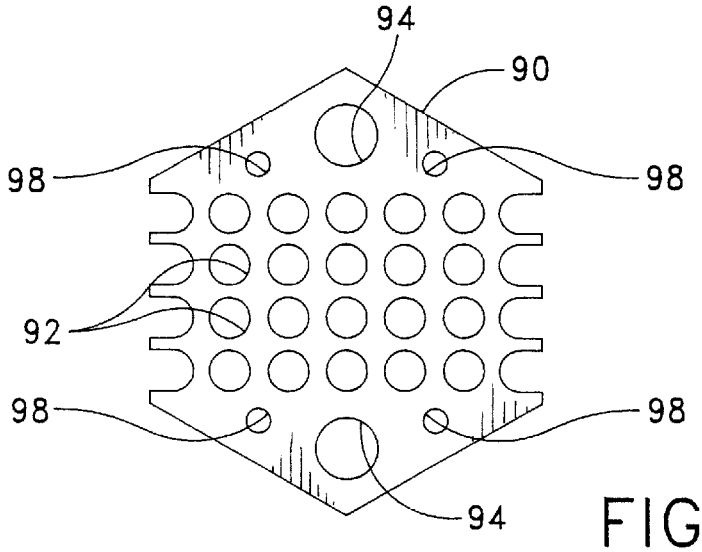
FIG. 7 is a top plan view of a rack of the socket tool illustrated in FIG. 6.
Figure 8:
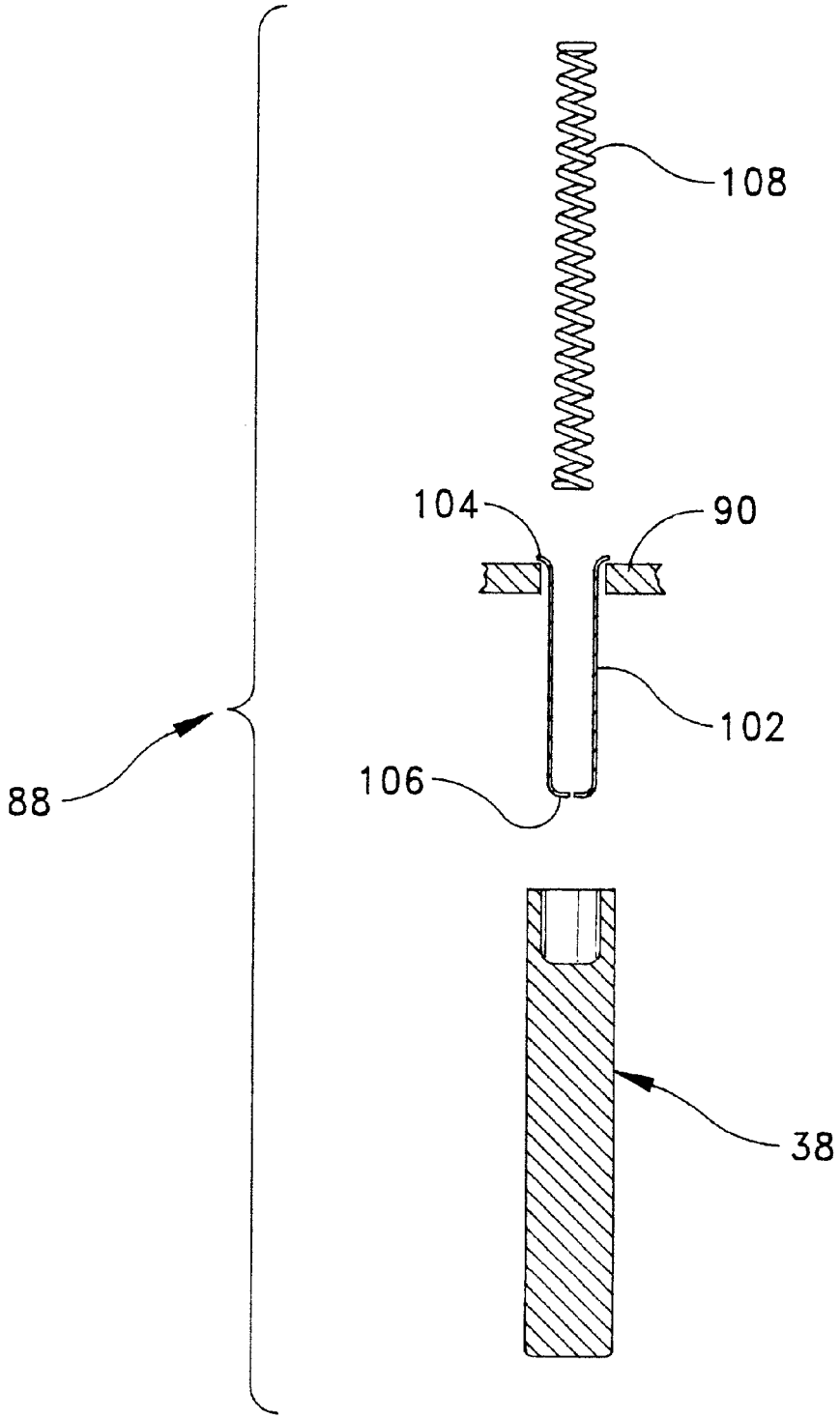
FIG. 8 is an exploded, cross-sectional, elevational view of the means for attaching the pins to the housing illustrated in FIG. 6.

Referring to FIGS. 6–8, another embodiment of the fastening mechanism is generally indicated at 88. As shown, the fastening mechanism 88 includes a rack plate 90 which is disposed horizontally within the chamber 28 of the housing in a position where it is spaced from end wall 62. As shown in FIG. 7, the rack plate 90 has an array of apertures 92 aligned to suspend the primary engagement pins 38 in a manner to be described below. Larger apertures 94 are provided for the secondary engagement pins 48.

The rack plate 90 is secured to the housing 22 by an inverted U-shaped pin 96 which is embedded within the layer of adhesive 66. As shown in FIGS. 6 and 7, the pin extends through a pair of small openings 98 formed in the rack plate 90, and has a pair of bulbous ends 100 which capture the plate within the chamber 28 of the housing 22.

Fastening mechanism 88 further includes an array of sleeves 102, one for each aperture 92 of the rack plate 90. Each sleeve 102 has an upper, open end with a radially outwardly projecting flange 104 which is disposed between the rack plate 90 and the end wall 62 and an opposite closed end 106 fixedly attached (e.g., by adhesive or welding) to the engagement pin 38. Each sleeve 102 is axially slidable within its respective aperture 92. Larger sleeves (not shown) are provided for the secondary engagement pins 48 and extend through the large apertures 98 in a similar manner.

A spring 108 is provided for each sleeve 102. As illustrated in FIG. 6, each spring 108 has an upper end embedded within the layer of adhesive 66 and a lower end disposed within the sleeve 102. This arrangement biases the sleeve 102 and the engagement pin 38 axially away from the housing 22.

It can therefore be seen that the instant invention provides an effective socket tool which overcomes several known drawbacks of the prior art, including reductions in the number of engagement pins, simplifying and reducing the cost of the housing, and providing a positive suspension system which will prevent the pins from being pulled out of the housing. For these reasons, the instant invention is believed to represent a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A universal socket tool comprising:

a rigid housing having a longitudinal chamber, said chamber having an end wall at its upper end and further having an open lower end;

an array of primary engagement pins each having upper and lower ends, said primary engagement pins being longitudinally oriented in said chamber, the lower ends of the pins being positioned adjacent the lower end of the chamber for engagement with a fastener element;

a pair of spaced apart, secondary engagement pins, each of said secondary engagement pins being triangular shaped in cross section, each of said secondary engagement pins having upper and lower ends, said secondary engagement pins also being longitudinally oriented in said chamber with the array of primary engagement pins disposed therebetween; and means for slidably suspending the primary and secondary engagement pins within the chamber of the housing.

2. The universal socket tool of claim 1, wherein each said primary engagement pin is square-shaped in cross-section.

3. The universal socket tool of claim 2, wherein said housing has a six sided inner chamber wall, said secondary engagement pins being disposed in opposite corners of the housing.

4. The universal socket tool of claim 1, wherein said suspension means comprises:

a plurality of springs each having first and second ends;

a first fastener connecting the first ends of the springs to the upper ends of the primary and secondary engagement pins; and a second fastener connecting the second ends of the springs to the upper end of the chamber of the housing.

5. The universal socket tool of claim 1, wherein said suspension means comprises:

an elongate guide element secured to the upper end of the chamber of the housing;

an elongate sleeve secured to the respective engagement pin, said guide element being axially movable within the sleeve; and a biasing element captured between the sleeve and the guide element, said biasing element being operative for biasing the pins away from the housing.

6. The universal socket tool of claim 5, wherein said guide element has a bulbous head portion and said sleeve has an annular-shaped end wall which engages the bulbous head portion for preventing the axial removal of the guide element from the sleeve.

7. The universal socket tool of claim 5, wherein said biasing element comprises a spring.

8. The universal socket tool of claim 1, said suspension means comprising:

a rack plate disposed horizontally within the chamber of the housing, said rack plate having an array of apertures formed therein which correspond to the array of primary and secondary engagement pins, said rack plate being spaced from the end wall of the housing;

an array of sleeves, one for each aperture of the rack plate, each sleeve having an open end with a radially outwardly projecting flange disposed between the rack plate and the end wall of the housing and a closed end fixedly attached to an engagement pin, each sleeve being axially slidable within the chamber; and an array of springs having first ends fixedly attached to the upper ends of the engagement pins and second ends disposed within the sleeve.

9. The universal socket tool of claim 1 wherein said longitudinal chamber of said housing is hexagonal-shaped in cross-section.

10. The universal socket tool of claim 9 wherein said array of primary engagement pins comprises a rectangular array having a opposing long sides, said triangular secondary engagement pins being positioned on said opposing long sides of said rectangular array.

11. The universal socket tool of claim 1 further comprising means for preventing said engagement pins from becoming disassembled from the housing.

* * * * *